US007415984B2

(12) United States Patent
Flowers et al.

(10) Patent No.: US 7,415,984 B2
(45) Date of Patent: Aug. 26, 2008

(54) TUB LIP ALIGNMENT SYSTEM FOR A DISHWASHER

(75) Inventors: Christopher L. Flowers, Humboldt, TN (US); Kory A. Gunnerson, Jackson, TN (US); John H. Miilu, Jackson, TN (US); John Trevor Morrison, Jackson, TN (US); Chad M. Thomas, Jackson, TN (US); Anthony Lewis Durfee, Jackson, TN (US)

(73) Assignee: Whirlpool Corporation, Benton Harbor, MI (US)

( * ) Notice: Subject to any disclaimer, the term of this patent is extended or adjusted under 35 U.S.C. 154(b) by 677 days.

(21) Appl. No.: 10/385,689

(22) Filed: Mar. 12, 2003

(65) Prior Publication Data

US 2004/0177869 A1 Sep. 16, 2004

(51) Int. Cl.
*A47L 15/42* (2006.01)
*B08B 3/00* (2006.01)

(52) U.S. Cl. ..... 134/57 D; 134/200; 49/475.1

(58) Field of Classification Search ..... 68/196; 134/200, 25.1, 25.2, 183, 57 D, 58 D, 101.1, 134/101.2; 220/378
See application file for complete search history.

(56) References Cited

U.S. PATENT DOCUMENTS 3,210,144 A 10/1965 Ullman, Jr. et al.
3,603,035 A 9/1971 Kaldenberg
3,837,120 A 9/1974 Hanks et al.
4,295,692 A 10/1981 Jenkins
4,998,550 A 3/1991 Archambault
5,115,826 A * 5/1992 Bertsch et al. ..... 134/183
5,230,553 A 7/1993 Tuller (Continued)

FOREIGN PATENT DOCUMENTS

DE 3229331 A1 * 2/1984

(Continued)

OTHER PUBLICATIONS

Translation of FR 2530943.*

(Continued)

*Primary Examiner*—Michael Barr
*Assistant Examiner*—Jason P Riggleman
(74) *Attorney, Agent, or Firm*—John Morrison; Michael D. LaFrenz

(57) ABSTRACT

A dishwasher, including a tub provided with a front lip, has a front door provided with alignment structure on an inner bottom portion which is designed to abut and deflect the front lip, when the front lip is bowed or otherwise deformed, to control the relative positioning between the door and the frontal lip in order to prevent the development of a leakage gap or undesirable engagement between the door and lip. The alignment feature preferably includes at least one cam rib located on the lower underside of the door, as well as adjacent abutment rib(s) adapted to extend toward the front lip of the tub when the door is opened. The cam rib functions to guide the lip along a smooth surface when the tub is bowed or otherwise significantly shifted from a design position to assure quiet shifting of the door, while the abutment rib functions to prevent the development of a potential leakage gap between the front lip and the door.

9 Claims, 5 Drawing Sheets

U.S. PATENT DOCUMENTS 5,966,873 A * 10/1999 Jerg et al. ..... 49/398

FOREIGN PATENT DOCUMENTS

| | | | | |
|---|---|---|---|---|
| EP | 1281345 | A1 | * | 2/2003 |
| FR | 2497653 | A | * | 7/1982 |
| FR | 2530943 | A | * | 2/1984 |
| GB | 2130082 | | | 11/1982 |
| GB | 2130479 | | | 11/1982 |
| JP | 2001292948 | A | * | 10/2001 |
| JP | 2002065554 | A | * | 3/2002 |
| WO | WO0105295 | A1 | * | 1/2001 |

OTHER PUBLICATIONS

Translation of JP 2002-65554A.*
Translation of Heissmeier DE3229331.*

* cited by examiner

TUB LIP ALIGNMENT SYSTEM FOR A DISHWASHER

BACKGROUND OF THE INVENTION

1. Field of the Invention

The present invention pertains to the art of dishwasher and, more particularly, to a system for assuring alignment between a door and a tub of a dishwasher.

2. Discussion of the Prior Art

In a typical dishwasher, washing fluid is pumped from a sump into upper and lower wash arms such that kitchenware retained on vertically spaced racks within a tub of the dishwasher will be sprayed with the washing fluid for cleaning purposes. The washing fluid is heated, filtered and recirculated. Prior to recirculating the washing fluid, the fluid is directed through one or more filters to remove soil from the fluid, with the soil being collected in a chamber. Periodically, the system will be purged in order to drain the collection chamber of the soil.

A conventional, domestic front loading dishwasher tub is supported on a kitchen floor under a countertop and includes top, bottom, opposing side and rear walls. In addition, the tub is formed with a low-level front wall which projects upward from the bottom wall in order to aid in containing the washing fluid within the tub. The front wall terminates in an upstanding lip having an upper edge which defines, at least in part, a frontal opening that is adapted to be selectively sealed off by a door mounted for pivotal movement relative to the tub. On the other hand, the door is typically formed of multiple components, particularly inner and outer door panels.

When the door is open, it is important that the bottom of the door remain sufficiently rearward of the front lip of the tub. Otherwise, a gap can be established between the bottom of the door and the front lip which would enable liquids or food spilled on the inner door panel, during loading or the like of the dishwasher, to drop onto the kitchen floor when the door is closed. This problem can be a significant issue, particularly given the fact that the front lip of a dishwasher can deform over time in the order of approximately ½ inch (1.27 cm) from a design position. Therefore, since the front lip has a tendency to bow or otherwise shift over time, a dishwasher originally designed to establish a reasonable overlap of the front lip can eventually still develop a rather large gap that can result in undesirable leakage.

The deformation of the front lip can also create certain problems in pivoting of the dishwasher door. For instance, the front lip can deform to such an extent wherein the door will engage the front lip upon closing. When this happens, an undesirable snapping or popping noise is generated. This is a particular issue in connection with dishwashers designed to have an initial, minimal clearance between the door and front lip.

Based on the above, there exists a need in the art of dishwashers for a system which maintains a proper alignment between a tub lip and a door wherein deformations of the front lip are accommodated in a manner that prevents the development of any leakage gap, while assuring a quiet and efficient opening and closing of the door.

SUMMARY OF THE INVENTION

The present invention is directed to an alignment feature provided along a lower inner door portion of a dishwasher to control the relative positioning between the door and a front tub lip in order to prevent the development of a leakage gap and/or undesirable engagement between the door and lip. In accordance with the most preferred embodiment of the invention, the alignment feature includes at least one cam rib located on the underside of the bottom of the door. The cam rib functions to ride on the lip when the tub is bowed or otherwise significantly shifted from a designed position. With this arrangement, a smooth engagement surface is established between the door and tub in order to deflect the front lip, as needed, for quiet shifting of the door.

The bottom of the door also preferably includes at least one abutment rib adapted to extend toward the front lip of the tub when the door is opened. More specifically, the abutment rib functions to prevent the development of a potential leakage gap between the front lip and the door by assuring a suitable overlap. In accordance with the invention, the abutment rib is adapted to extend below an uppermost edge of the front lip at a position inside of the tub, and to both engage and deflect the front lip, as needed, upon fully opening the door in order to eliminate any leakage gap.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
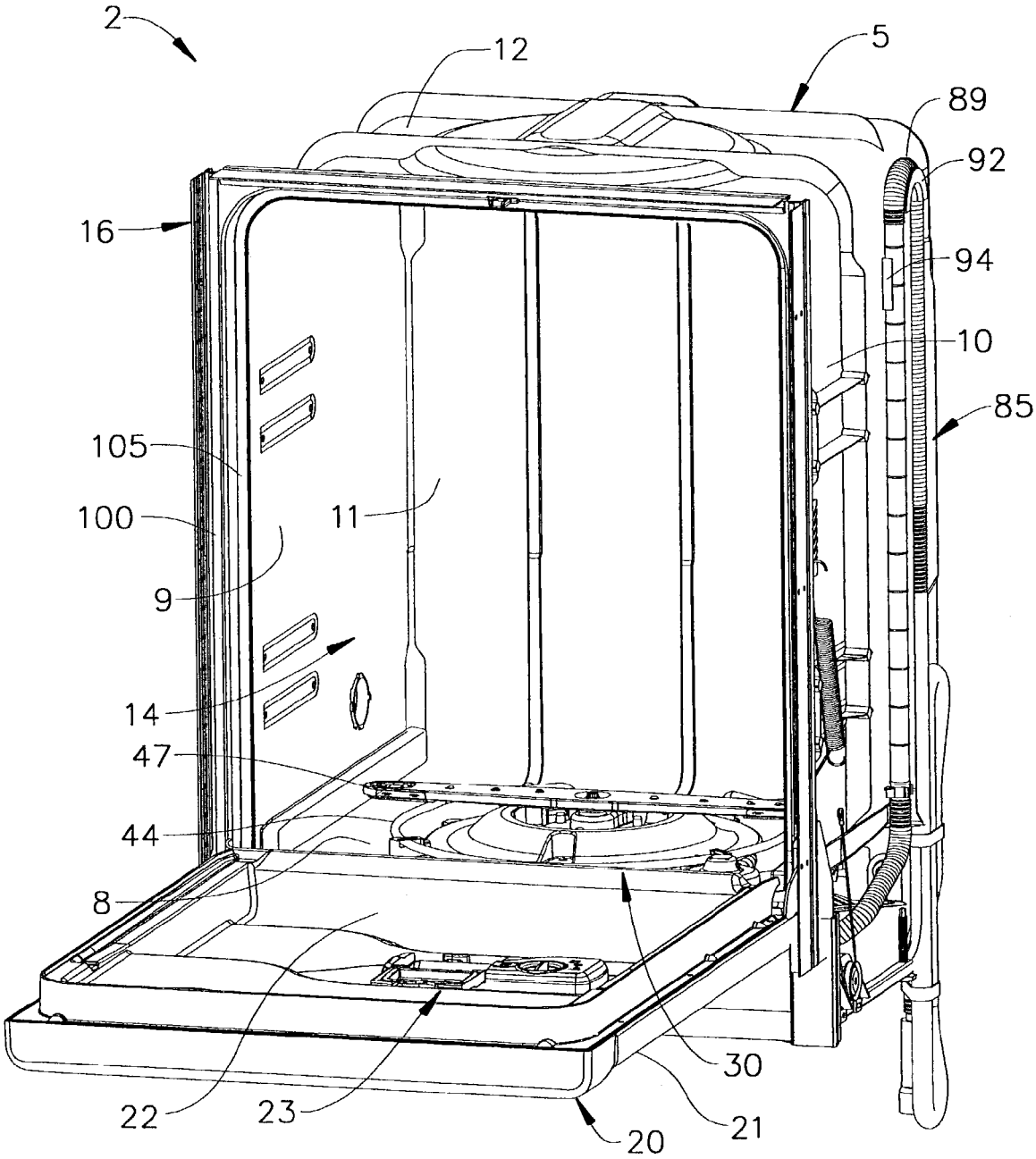
FIG. 1 is an upper right perspective view of a dishwasher constructed in accordance with the present invention, with a door of the dishwasher being open to illustrate internal tub structure.

With initial reference to FIG. 1, a dishwasher constructed in accordance with the present invention as generally indicated at 2. As shown, dishwasher 2 includes a tub 5 which is preferably injection molded of plastic so as to include integral bottom, side, rear and top walls 8-12 respectively. Within the confines of walls 8-12, tub 5 defines a washing chamber 14 within which soiled kitchenware is adapted to be placed upon shiftable upper and lower racks (not shown), with the kitchenware being cleaned during a washing operation in a manner widely known in the art. Tub 5 has attached thereto a frontal frame 16 which pivotally supports a door 20, including an outer panel 21 and an inner panel 22, used to seal chamber 14 during a washing operation. In connection with the washing operation, inner panel 22 of door 20 is preferably provided with a detergent tray assembly 23 within which a consumer can place liquid or particulate washing detergent for dispensing at predetermined portions of the washing operation. Of course, this general construction of dishwasher 2 is known in the art such that this structure has only been described for the sake of completeness.

Disposed within tub 5 and, more specifically, mounted within a central opening formed in bottom wall 8 of tub 5, is a pump and filter assembly 30. Extending about a substantial portion of pump and filter assembly 30, at a position raised above bottom wall 8, is a heating element 44. In a manner known in the art, heating element 44 preferably takes the form of a sheath, electric resistance-type heating element.

In general, pump and filter assembly 30 is adapted to direct washing fluid to a lower wash arm 47 and an upper wash arm (not shown). Dishwasher 2 has associated therewith a drain hose 85 including at least one corrugated or otherwise curved portion 89 that extends about an arcuate hanger 92 provided on an outside surface of side wall 10. Drain hose 85 is also preferably secured to tub 5 through various clips, such as that indicated at 94. In any event, in this manner, an upper loop is maintained in drain hose 85 to assure proper drainage in a manner known in the art. Actually, a detailed description of the exact structure and operation of pump and filter assembly 30 of dishwasher 2 does not form part of the present invention, but is rather set forth in pending U.S. application Ser. No. 10/186,739 entitled "Dishwasher Pump and Filtration System" filed Jul. 2, 2002, incorporated herein by reference.

Figure 2:
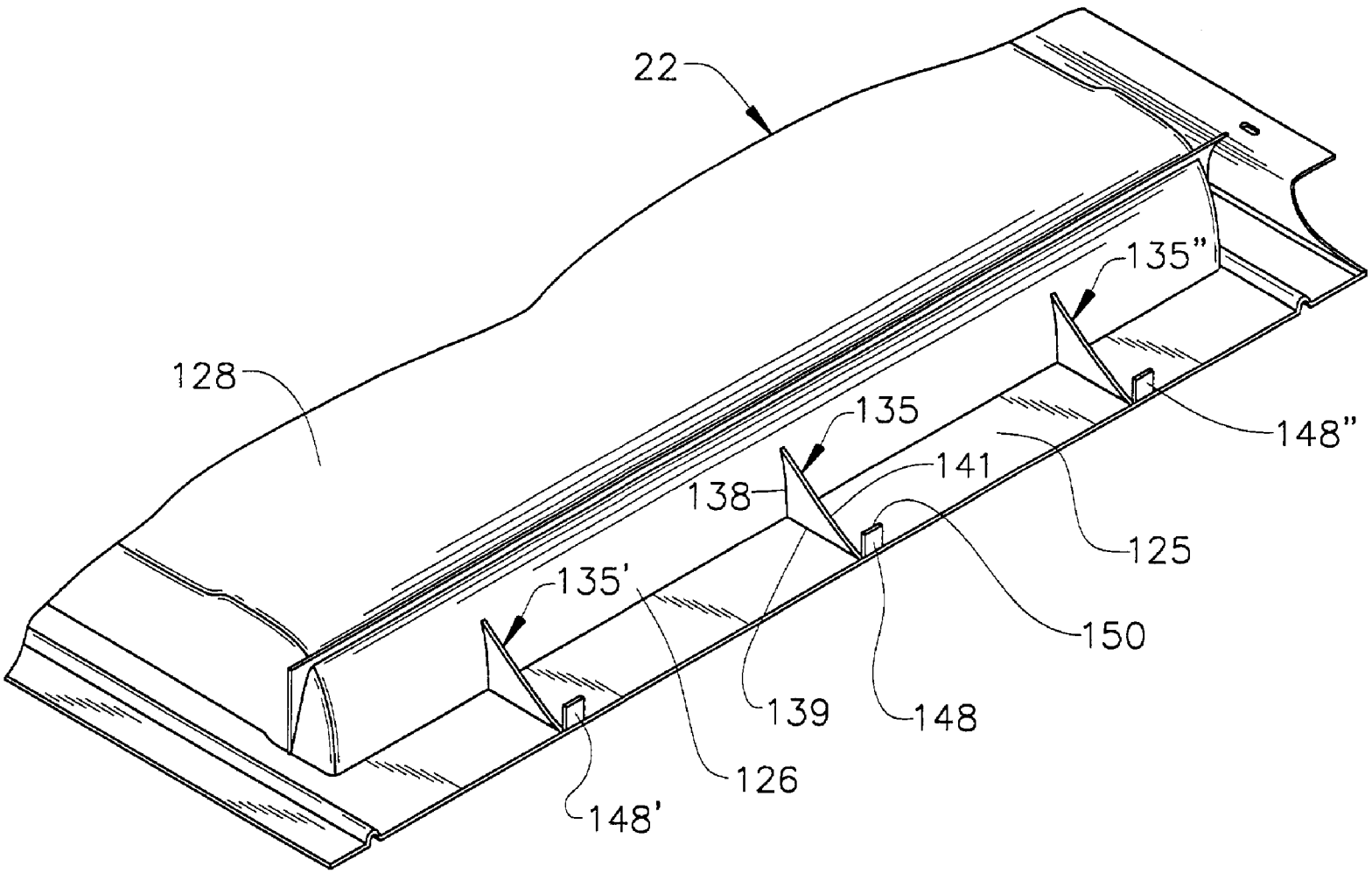
FIG. 2 is an enlarged perspective view of a rear portion of the door of FIG. 1.

Instead, the present invention is particularly directed to the construction of door 20 and its interaction with tub 5. With reference to FIG. 2, inner panel 22 is shown formed with a lowermost portion 125 that is actually defined at an underside of door 20. Adjacent lowermost portion 125 is an arcuate intermediate portion 126 which leads to a raised portion 128. Of particular concern to the present invention is the structure provided along lowermost portion 125. More specifically, inner panel 22, which is integrally formed of plastic, includes a cam rib 135. In the preferred embodiment shown, cam rib 135 is centrally located within lowermost portion 125. As illustrated, cam rib 135 includes a first side 138 which is joined to intermediate portion 126, a second side 139 which is joined with lowermost portion 125, and an exposed, arcuate or sloping surface 141. In the most preferred form of the invention, arcuate surface 141 is concave in shape. As will be detailed more fully below, cam rib 135 is designed to interact with a portion of tub 5 during pivoting of door 20.

Also projecting from lowermost portion 125 of inner panel 22 is an abutment rib 148 having a terminal tip 150. In the most preferred embodiment shown, abutment rib 148 is positioned slightly below cam rib 135, centrally within lowermost portion 125, is generally tooth-shaped, and extends substantially perpendicular to lowermost portion 125. As perhaps better shown in FIGS. 3-5 which does not illustrate outer panel 21 of door 20 for clarity purposes, abutment rib 148 extends away from lowermost portion 125 and is substantially flush with a bottom surface 153 of door 20, which is also provided with a projection 155 adapted to abut bottom 8 when door 20 is closed (see FIG. 5). As also clearly shown in each of FIGS. 3-5, tub 5 further includes a low-level front wall 160 which defines an upstanding front lip 163. Lip 163 has a front surface 165, a rear surface 166 and an upper edge 167.

Figure 3:
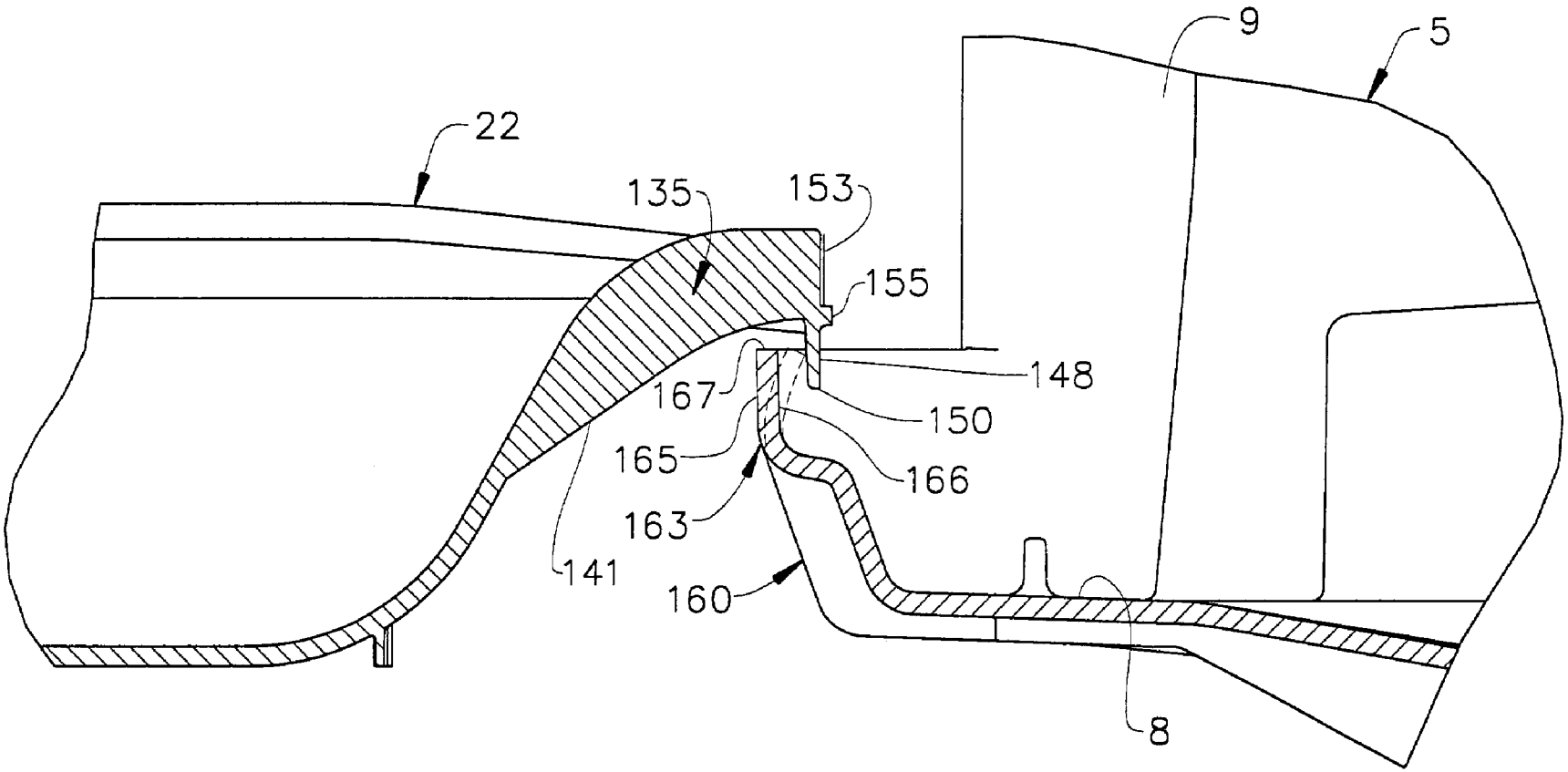
FIG. 3 is a partial, cross-sectional side view of a portion of the tub and door of the dishwasher, with the door being shown in a fully open position.
Figure 4:
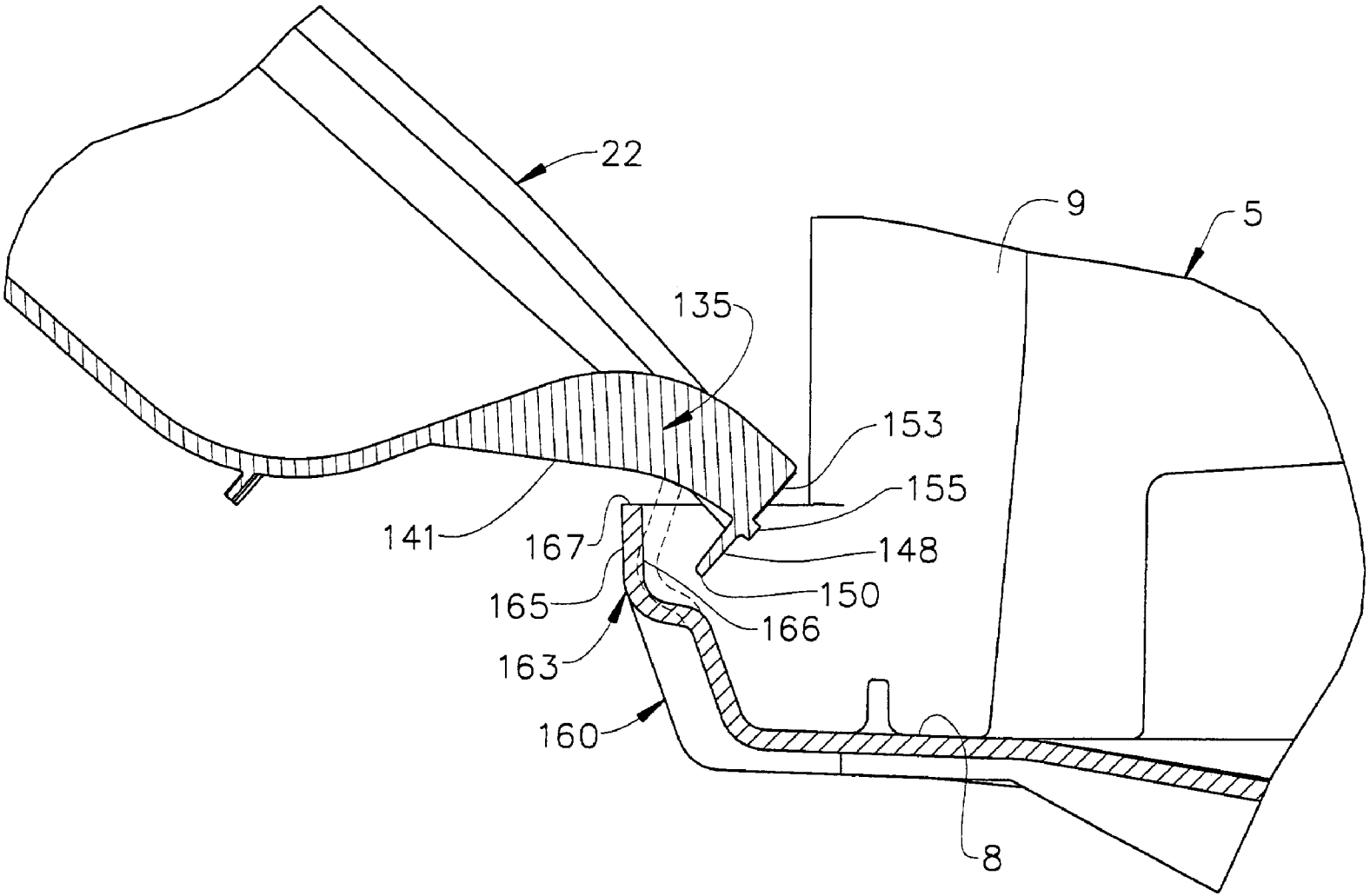
FIG. 4 is a partial, cross-sectional side view of a portion of the tub and door of the dishwasher, similar to that of FIG. 3, with the door being shown in an initial closing position.
Figure 5:
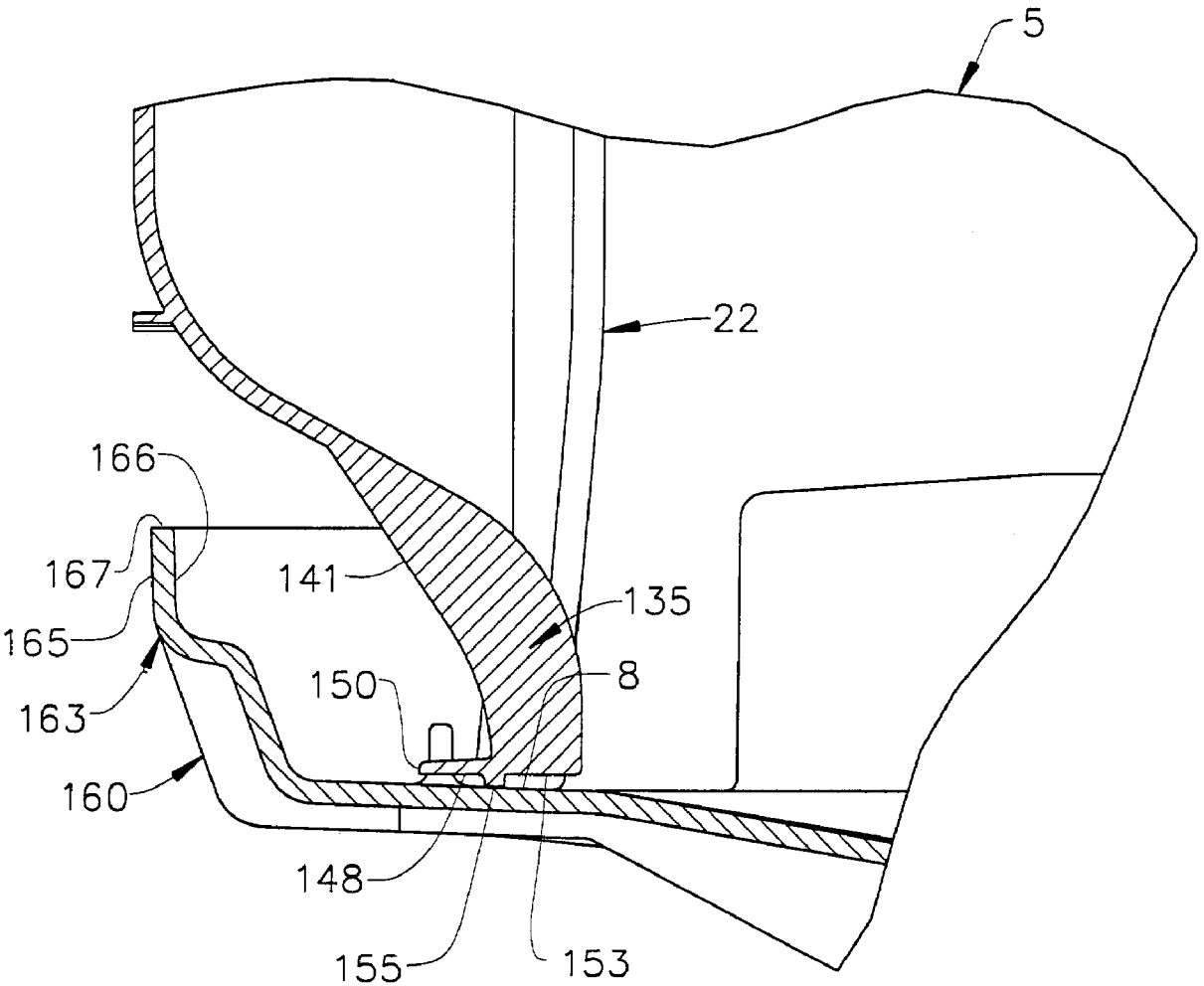
FIG. 5 is a partial, cross-sectional side view of a portion of the tub and door of the dishwasher, similar to that of FIGS. 3 and 4, with the door shown in a fully closed position.

Throughout the operational life of dishwasher 2, front lip 163 can bow or otherwise deform from an initial, desired position. FIGS. 3-5 illustrate the desired position for front lip 163 relative to at least lowermost portion 125 of inner panel 22, from the door open position of FIG. 3 to the door closed position of FIG. 5, in solid lines. At this point, it should be realized that the solid line arrangements in these figures generally represent the ideal situation wherein front lip 163 has not significantly bowed or otherwise deformed. However, it has been found that front lip 163 can actual deform by as much as approximately ½ inch (1.27 cm). This deformation can have a significant impact on the perceived quality of dishwasher 2.

For instance, in reference to FIG. 3, if front lip 163 bows so as to assume a position which is located rearward of door 20 in the open position, i.e., to the right in FIG. 3 beyond bottom surface 153, then any spillage of fluid or food on inner panel 22 upon loading of dishwasher 2 can run down inner panel 22 and spill onto a supporting surface, such as a household kitchen floor (not shown). Therefore, since front lip 163 has a tendency to bow or otherwise shift over time, dishwasher 2 originally designed to establish a reasonable overlap between door 20 and front lip 163 can eventually still develop a rather large gap that can result in undesirable spillage.

To address this concern, abutment rib 148 is specifically configured to extend behind rear surface 166 and below upper edge 167 of front lip 163 when door 20 is fully open as clearly shown in FIG. 3. However, if front lip 163 bowed rearward such as indicated in dotted lines in FIG. 3, abutment rib 148 would engage rear surface 166 upon the opening of door 20 and cause front lip 163 to deflect so as to assure that front lip 163 is located forward of bottom surface 153 of door 20. Therefore, although front lip 163 could actually shift to a position to the right or left in FIG. 3, abutment rib 148 will assure that no gap can be created which would enable food or liquid that falls upon inner panel 22 to undesirably spill onto a supporting floor. Instead, with bottom surface 153 being maintained behind a plane defined by rear surface 166 of front lip 163, any food or liquid on inner panel 22 will be assured to fall into tub 5 when door 20 is closed.

The deformation of front lip 163 can also create certain problems in pivoting of door 20. For instance, front lip 163 can deform to such an extent wherein a portion of door 20 spaced from abutment rib 148 will engage front lip 163 upon closing. When this happens, an undesirable snapping or popping noise can be generated. This is a particular issue in connection with dishwashers designed to have an initial, minimal clearance between door 20 and front lip 163. For instance, dishwasher 2 with a tall door 20 may be designed to have a clearance in the order of two-hundred thousands of an inch (5 mm). Obviously, it would not take too much deformation of front lip 163 to cause door 20 to abut front lip 163 upon closing. In the case where door 20 initially causes front lip 163 to deflect upon closing and then front lip 163 snaps back into position upon further shifting of door 20, the referenced noise can occur.

However, in accordance with the present invention, whenever a contact situation between inner panel 22 and front lip 163 develops, upper edge 167 of front lip 163 will actually engage cam rib 135 (particularly see dotted representation of front lip 163 in FIG. 4). With this arrangement, the pivoting of door 20 will cause front lip 163 to deflect, while riding along arcuate surface 141 of cam rib 135. Therefore, a gradually increasing force will be applied to and subsequently released from front lip 163 such that no abrupt noises are developed and door 20 is allowed to pivot smoothly.

Based on the above discussion, it should be readily apparent that incorporating cam rib 135 and abutment rib 148 in accordance with the present invention solves various potential problems which could develop due to the deformation of front lip 163 of tub 5. In general, it has been found that a single cam rib 135 located at a central lower portion of door 20 can be sufficient since the attachment of front lip 163 to side walls 9 and 10 establish this as the largest potential deflection zone. The same holds for the positioning of abutment rib 148. However, in accordance with the most preferred form of the invention, additional alignment structure in the form of correspondingly constructed cam ribs 135' and 135" and abutment ribs 148' and 148" are provided along lowermost portion 125 at spaced positions on either side of cam rib 135 and abutment rib 148. In any case, although described with reference to a preferred embodiment of the invention, it should be readily understood that various changes and/or modifications can be made to the invention without departing from the spirit thereof. For instance, it would certainly be possible to provide additional or substitute cam and abutment ribs or, in fact, employ elongated cam and abutment ribs across a select section of lowermost portion 125. In addition, although cam and abutment ribs 135 and 148 are preferably formed integral with inner door panel 22, they could be formed as separate pieces and appropriately attached to door 20, particularly if the door is formed of one piece. In general, the invention is only intended to be limited by the scope of the following claims.

We claim:

1. A dishwasher for receiving and cleansing soiled kitchenware by spraying washing fluid onto the kitchenware from at least one wash arm comprising:

a tub having bottom, opposing side, rear and top walls which collectively define a washing chamber, said tub including a front lip;

a door mounted for movement relative to the tub for exposing the washing chamber, said door including an inner bottom portion;

alignment structure provided on the inner bottom portion of the door, wherein an initial clearance is established between the alignment structure and the tub, but when the front lip bows or otherwise shifts to a deformed position, the alignment structure purposely engages the front lip of the tub to deflect the front lip upon movement of the door relative to the tub, wherein the alignment structure includes a plurality of abutment ribs extending from and spaced along the inner bottom portion of the door.

2. A dishwasher for receiving and cleansing soiled kitchenware by spraying washing fluid onto the kitchenware from at least one wash arm comprising:

a tub having bottom, opposing side, rear and top walls which collectively define a washing chamber, said tub including a front lip;

a door mounted for movement relative to the tub for exposing the washing chamber, said door including an inner bottom portion;

alignment structure provided on the inner bottom portion of the door, with the alignment structure including an abutment rib extending from the inner bottom portion of the door, wherein an initial clearance is established between the alignment structure and the tub, but when the front lip bows or otherwise shifts to a deformed position, the alignment structure purposely engages the front lip of the tub to deflect the front lip upon movement of the door relative to the tub, wherein the alignment structure further includes a cam rib extending from the inner bottom portion of the door.

3. The dishwasher according to claim 2, wherein the cam rib includes an arcuate surface upon which the front lip is adapted to ride.

4. The dishwasher according to claim 3, wherein the arcuate surface is concave.

5. The dishwasher according to claim 3, wherein the cam rib is located above the abutment rib.

6. The dishwasher according to claim 3, wherein the alignment structure includes a plurality of cam ribs spaced along the inner bottom portion of the door.

7. The dishwasher according to claim 2, wherein the cam rib deflects the front lip downward upon shifting of the door when the front lip has bowed or otherwise shifted to the deformed position.

8. The dishwasher according to claim 2, wherein the door includes inner and outer panels, both of said abutment and cam ribs being molded integral with the inner panel.

9. A dishwasher for receiving and cleansing soiled kitchenware by spraying washing fluid onto the kitchenware from at least one wash arm comprising:

a tub having bottom, opposing side, rear and top walls which collectively define a washing chamber, said tub including a front lip;

a door mounted for movement relative to the tub for exposing the washing chamber, said door including an inner bottom portion;

alignment structure provided on the inner bottom portion of the door, with the alignment structure including a plurality of cam ribs extending from and spaced along the inner bottom portion of the door, wherein an initial clearance is established between the alignment structure and the tub, but when the front lip bows or otherwise shifts to a deformed position, the alignment structure purposely engages the front lip of the tub to deflect the front lip upon movement of the door relative to the tub, and wherein the plurality of cam ribs include arcuate surfaces upon which the front lip is adapted to ride.

* * * * *